US006591981B2

(12) United States Patent
Draghetti

(10) Patent No.: US 6,591,981 B2
(45) Date of Patent: Jul. 15, 2003

(54) RIGID PACKET OF CIGARETTES

(75) Inventor: Fiorenzo Draghetti, Medicina (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 10/196,861

(22) Filed: Jul. 17, 2002

(65) Prior Publication Data

US 2003/0038044 A1 Feb. 27, 2003

Related U.S. Application Data

(63) Continuation of application No. PCT/IT01/00025, filed on Jan. 18, 2001.

(30) Foreign Application Priority Data

Jan. 18, 2000 (IT) ..... BO2000 A 0009

(51) Int. Cl.[7] ..... B65D 85/10

(52) U.S. Cl. ..... 206/247; 206/268; 206/273

(58) Field of Search ..... 206/247, 265, 206/268, 271, 273, 459.5, 807; 229/160.1, 87.13; 340/572.8; 428/900

(56) References Cited

U.S. PATENT DOCUMENTS

| | | | | | |
|---|---|---|---|---|---|
| 4,836,378 | A | * | 6/1989 | Lephardt | 206/264 |
| 5,428,346 | A | * | 6/1995 | Franklin | 340/572.8 |
| 5,823,350 | A | * | 10/1998 | Ward | 206/807 |
| 5,826,785 | A | * | 10/1998 | Belvederi et al. | 229/160.1 |
| 5,931,292 | A | * | 8/1999 | Focke et al. | 206/264 |
| 6,209,290 | B1 | * | 4/2001 | Boriani et al. | 53/445 |

* cited by examiner

*Primary Examiner*—Luan K. Bui
(74) *Attorney, Agent, or Firm*—Marshall, Gerstein & Borun

(57) ABSTRACT

A rigid packet (1) of cigarettes, wherein an outer wrapping (2) of multilayer cardboard encloses a group (3) of cigarettes wrapped in an inner wrapping (4), and wherein a portion (21) of magnetic material is located within the thickness of a wall of the outer casing (2).

6 Claims, 2 Drawing Sheets

RIGID PACKET OF CIGARETTES

CROSS REFERENCE TO RELATED APPLICATION

This is a continuation of international application PCT/IT01/00025, filed Jan. 18, 2001.

TECHNICAL FIELD

The present invention relates to a rigid packet of cigarettes.

BACKGROUND ART

Known rigid packets are normally parallelepiped-shaped and comprise an inner wrapping of foil or paper wrapped about a group of cigarettes; and an outer wrapping in turn comprising a parallelepiped-shaped box normally formed from a blank with preformed bend lines, and a collar interposed between the box and the inner wrapping.

Packets of the above type are known, from Patent EP 317202, to be provided with respective magnetic tapes or media visible from the outside and for recording data unequivocally identifying the respective packets. In other words, the magnetic tape, or medium in general, constitutes, for the respective packet, a certificate of origin making counterfeiting of the packet extremely complicated and expensive.

One of the drawbacks of packets of the above type lies in the magnetic tape or medium being visible from the outside. That is to say, while not being made easier to counterfeit, the fact that the magnetic media are visible from the outside inevitably results in a relaxation of security measures, in the sense that distributors or retailers eventually simply check to determine the presence of the magnetic medium, as opposed to the data recorded on it.

DISCLOSURE OF INVENTION

It is an object of the present invention to provide a packet of cigarettes having a data recording element with magnetic properties, and wherein said element with magnetic properties is not only invisible from the outside, but is also located in a precise, unalterable position on the packet.

According to the present invention, there is provided a rigid packet of cigarettes, comprising at least one outer wrapping about a group of cigarettes, and at least one means with magnetic properties; characterized in that said outer wrapping is made of multilayer cardboard of a given thickness; and said means with magnetic properties is located in a fixed position within the thickness of a wall of said outer wrapping.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
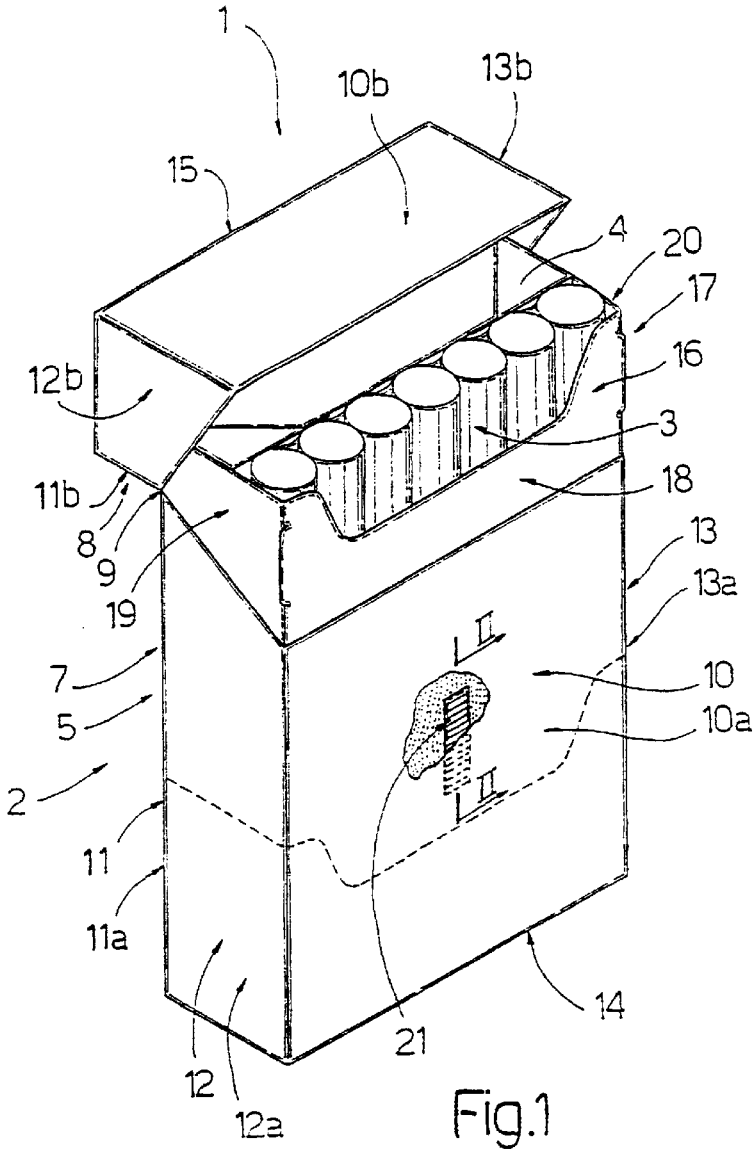
FIG. 1 shows a view in perspective of a preferred embodiment of the packet according to the present in the open position.

Number 1 in FIG. 1 indicates as a whole a packet of cigarettes comprising a substantially rigid outer wrapping 2 housing a group 3 of cigarettes enclosed in a foil inner wrapping 4.

Outer wrapping 2 comprises a box 5 formed by folding in known manner an originally flat blank 6, which may be made of multilayer cardboard or similar of a given thickness. Box 5 in turn comprises a bottom cup-shaped container 7; and a cup-shaped lid 8 hinged to container 7 along a hinge line 9 to rotate, with respect to container 7, between a closed position (not shown) and an open position as shown in FIG. 1.

Box 5 is substantially in the form of a right parallelepiped, and comprises two major lateral walls 10 and 11; wall 10 being located at the front and defining a front wall 10*a* of container 7 and a front wall 10*b* of lid 8; and wall 11 being located at the rear and defining a rear wall 11*a* of container 7 and a rear wall 11*b* of lid 8. Box 5 also comprises two minor lateral walls 12 and 13, each defining a respective lateral wall 12*a*, 13*a* of container 7 and a respective lateral wall 12*b*, 13*b* of lid 8. Finally, box 5 also comprises a bottom wall 14 and a top wall 15 forming part of container 7 and lid 8 respectively.

Outer wrapping 2 also comprises a collar 16, which may be made of multilayer cardboard and is located between box 5 and inner wrapping 4 so that a portion 17 of the collar projects from container 7 and, when lid 8 is closed, is housed inside lid 8. Collar 16 comprises a front wall 18 parallel to, and directly contacting the inner surface of, front major lateral 10 of box 5; and two lateral walls 19 and 20 parallel to, and directly contacting the inner surface of, minor lateral walls 12 and 13 of box 5.

Figure 2:
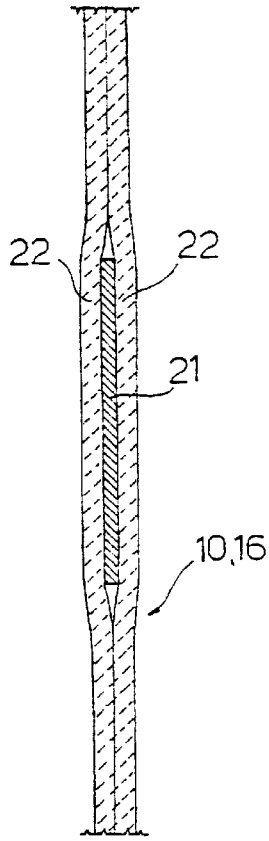
FIG. 2 shows a section along line II—II in FIG. 1.

Packet 1 comprises a portion 21 of magnetic data recording material, which, as shown more clearly in FIG. 2, is located in a fixed position between two layers 22 of blank 6 or of collar 16.

Portion 21 of magnetic material may be applied, as described later on, in any position on blank 6 or collar 16, but is preferably located, as shown in FIG. 1, a sufficient distance from bottom wall 14, top wall 15 and minor lateral walls 12 and 13, which walls 14, 15, 12 and 13 may undergo, during the application of an overwrapping (not shown), to operations involving a considerable increase in temperature which could damage portion 21.

Blank 6 (FIG. 3)—the parts of which are indicated, wherever possible, using the same reference numbers, with superscripts, as for the corresponding walls of box 5—extends substantially longitudinally along a longitudinal axis 23 of symmetry, and comprises a number of preformed transverse bend lines 24, i.e. perpendicular to longitudinal axis 23, and two preformed longitudinal bend lines 25, i.e. parallel to and on either side of longitudinal axis 23, along which blank 6 is folded to form box 5.

Longitudinal bend lines 25 divide blank 6 into a central portion 26, and into two lateral portions 27 on either side of central portion 26.

Along central portion 26, blank 6 comprises an end tab 28, which, when forming box 5, is folded inside front wall 10*b* of lid 8.

Along each lateral portion 27, blank 6 comprises four tabs 29—32, which, when forming box 5, are superimposed—tab 29 on tab 30, and tab 32 on tab 31—to form a respective minor lateral wall 12, 13 of box 5.

Figure 3:
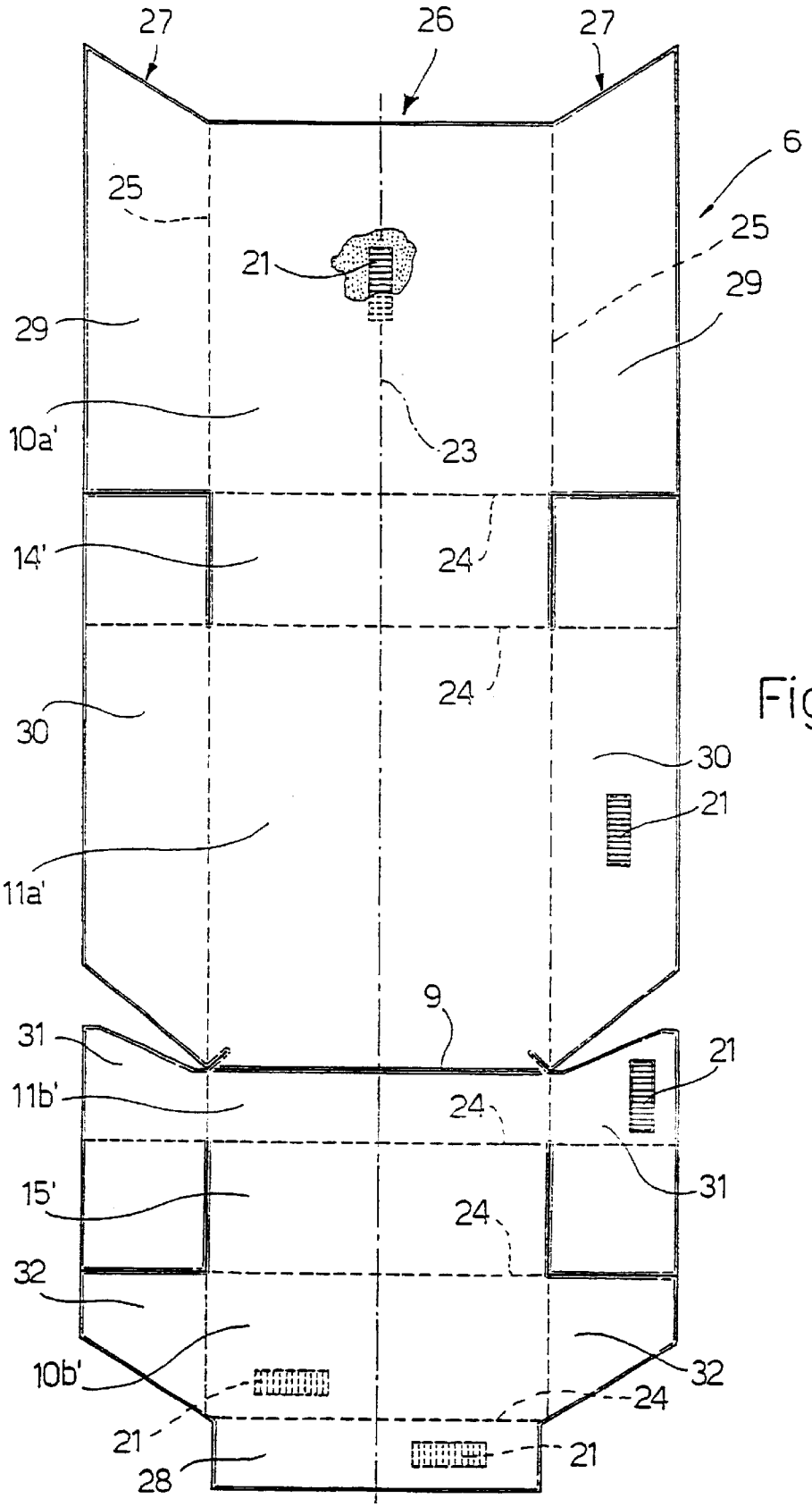
FIG. 3 shows a layout of a blank from which to form the FIG. 1 packet, and showing a detail of FIGS. 1 and 2 in various alternative positions.

In the first embodiment of the invention described above, portion 21 of magnetic material is applied, off the machine, between layers 22 of blank 6 or collar 16, whereas, in a variation shown in FIG. 3, portion 21 of magnetic material is applied, on the machine, to one of tabs 30 or 31 of blank 6—preferably at the minor lateral wall 12 or 13 unaffected by heat sealing of the overwrapping (not shown)—so as to be embedded in the thickness of one of the walls of the finished box 5.

In a further variation shown in FIG. 3, portion 21 of magnetic material is applied, on the machine, to tab 28 or to the inner face of wall 10*b*', so as to be located between tab 28 and wall 10*b* when forming box 5, and therefore inside the thickness of front wall 10*b* of lid 8 of the finished box 5.

What is claimed is:

1. A rigid packet of cigarettes, comprising an outer wrapping (2) about a group (3) of cigarettes, and at least one means (21) with magnetic properties; the outer wrapping (2) being made of multilayer cardboard of a given thickness and comprising a number of layers (22); the packet being characterized in that the means (21) with magnetic properties is located in a fixed position within the thickness of a wall of said outer wrapping (2) in order to be arranged between two adjacent layers (22) of said multilayer cardboard.

2. The packet as claimed in claim 1, wherein said outer wrapping (2) comprises a parallelepiped-shaped box (5) having two major lateral walls (10, 11) and defined by a container (7) and by a lid (8) hinged to each other, and by a collar-type wall (16) fitted to said container (7) and extending inside said lid (8); said means (21) with magnetic properties being located between the layers (22) of a portion of said multilayer cardboard defining a said major lateral wall (10; 11).

3. The packet as claimed in claim 1, wherein said outer wrapping (2) comprises a parallelepiped-shaped box (5) having two major lateral walls (10, 11) and defined by a container (7) and by a lid (8) hinged to each other, and by a collar-type wall (16) fitted to said container (7) and extending inside said lid (8); said means (21) with magnetic properties being located between the layers (22) of a portion of said multilayer cardboard defining said collar-type wall (16).

4. The packet as claimed in claim 1, wherein said outer wrapping (2) comprises a parallelepiped-shaped box (5) having two major lateral walls (10, 11) and two minor lateral walls (12, 13), and defined by a container (7) and by a lid (8) hinged to each other; and a collar-type wall (16) fitted to said container (7) and extending inside said lid (8); said box (5) being formed by folding a blank (6); at least one said wall (12; 13; 10*b*) being defined by two superimposed integral portions of said blank (6); and said means (21) with magnetic properties being located between said two portions.

5. The packet as claimed in claim 4, wherein said wall is a minor lateral wall (12; 13) of said box (5).

6. The packet as claimed in claim 4, wherein said wall is a front wall (10*b*) of said lid (8).

* * * * *